US005141624A

United States Patent [19]

Liao et al.

[11] Patent Number: 5,141,624

[45] Date of Patent: Aug. 25, 1992

[54] CATALYTIC CRACKING PROCESS

[75] Inventors: Ping-Chau Liao, Bartlesville, Okla.; Douglas D. Klendworth, Erie, Ill.; Fu M. Lee, Bartlesville, Okla.

[73] Assignee: Phillips Petroleum Company, Bartlesville, Okla.

[21] Appl. No.: 331,995

[22] Filed: Mar. 30, 1989

[51] Int. Cl.[5] ..... C10G 11/05

[52] U.S. Cl. ..... 208/52 CT; 208/113; 208/120; 208/122; 208/149

[58] Field of Search ..... 208/113, 52 CT, 118, 208/119, 120, 121, 122, 149

[56] References Cited

U.S. PATENT DOCUMENTS

| | | | |
|---|---|---|---|
| 3,835,031 | 9/1974 | Bertolacini et al. | 208/120 |
| 3,909,392 | 9/1975 | Horecky, Jr. et al. | 208/120 |
| 4,146,463 | 3/1979 | Radford et al. | 208/120 |
| 4,147,613 | 4/1979 | Gladrow | 208/120 |
| 4,158,621 | 6/1979 | Swift et al. | 208/114 |
| 4,292,169 | 9/1981 | Gladrow | 208/120 |
| 4,312,743 | 1/1982 | Tu et al. | 208/120 |
| 4,377,470 | 3/1983 | Hettinger, Jr. et al. | 208/120 |
| 4,423,019 | 12/1983 | Bertolacini et al. | 423/244 |
| 4,424,116 | 1/1984 | Hettinger, Jr. | 208/120 |
| 4,465,588 | 8/1984 | Occelli et al. | 208/120 |
| 4,515,902 | 5/1985 | Shioiri et al. | 502/64 |
| 4,515,903 | 5/1985 | Otterstedt et al. | 502/68 |
| 4,692,236 | 9/1987 | Sato et al. | 208/114 |
| 4,781,816 | 10/1987 | Lee et al. | 208/120 |
| 4,889,615 | 12/1989 | Chin et al. | 208/113 |

FOREIGN PATENT DOCUMENTS

| | | |
|---|---|---|
| 278535 | 8/1988 | European Pat. Off. . |
| 2138314 | 10/1984 | United Kingdom . |

OTHER PUBLICATIONS

"Petroleum Refining", by James H. Gary and Glenn E. Handwerk, 1975, Marcel Dekker, Inc., pp. 86–95, 101, 110 and 111.

*Primary Examiner*—Anthony McFarlane
*Attorney, Agent, or Firm*—K. K. Brandes

[57] ABSTRACT

A catalytic process for cracking vanadium-containing oils employs a physical mixture of (a) zeolite embedded in an inorganic matrix material and (b) magnesium oxide on alumina support.

19 Claims, No Drawings

CATALYTIC CRACKING PROCESS

BACKGROUND OF THE INVENTION

This invention relates to a catalytic cracking process. In another aspect, this invention relates to a process for cracking heavy oils which contain metal impurities.

Cracking catalysts comprising zeolite embedded in a matrix of inorganic refractory materials are known. Also the use of these cracking catalysts for cracking hydrocarbon containing oils, such as gas oil, is known. Frequently, these known cracking catalysts exhibit conversion and selectivity problems when heavier feedstocks, such as topped crudes and hydrotreated residua, which also contain metal impurities are employed. This invention is directed to the use of a cracking catalyst composition which exhibits improved cracking performance in processes for cracking heavy oils which contain vanadium compounds as impurities.

SUMMARY OF THE INVENTION

It is an object of this invention to provide a novel process for cracking hydrocarbon containing feedstocks which contain vanadium compounds as impurities. It is another object of this invention to employ a cracking catalyst composition comprising a mixture of an alumina-containing material and a zeolite-containing catalyst. Other objects and advantages will become apparent from the detailed description and the appended claims.

In accordance with this invention, a catalytic cracking process comprises the step of contacting in a cracking zone a hydrocarbon containing feed stream which has an initial boiling point of at least about 400° F., measured at about 0 psig, and contains vanadium impurities with a cracking catalyst composition comprising a physical mixture of (a) zeolite embedded in an inorganic refractory matrix material, and (b) magnesium oxide on alumina support material, under such catalytic cracking conditions as to obtain at least one liquid hydrocarbon containing product stream (i.e., one or two or more than two product streams) having a lower initial boiling point and a higher API gravity than said feed stream.

Preferably, the cracking process of this invention comprises the additional steps of removing said cracking catalyst composition from said cracking zone after it has been used in said cracking zone;

separating the thus removed cracking catalyst composition from gases and said at least one liquid product stream;

exposing at least a portion of the thus separated catalyst composition to flowing steam (for stripping of adhered liquids from the catalyst composition); and heating the thus steam-stripped cracking catalyst composition with a free oxygen containing gas, so as to substantially remove coke deposits from the catalyst composition, substantially convert vanadium compounds deposited thereon to vanadium oxide, and thus obtain a regenerated catalyst composition.

More preferably the cracking process of this invention comprises the additonal step of recycling at least a portion of the regenerated catalyst (to which generally fresh, unused catalyst composition has been added, so as to provide an equilibrium catalyst) to said cracking zone.

DETAILED DESCRIPTION OF THE INVENTION

Cracking Catalyst Composition

The zeolite component of the cracking catalyst composition which is employed in the process of this invention can be any natural or synthetic crystalline aluminosilicate zeolite which exhibits cracking activity. Nonlimiting examples of such zeolites are faujasite, chabazite, mordenite, offretite, erionite, Zeolon, zeolite X, zeolite Y, zeolite L, zeolite ZSM-4, zeolite ZSM-5, zeolite ZSM-11, zeolite ZSM-12, zeolite ZSM-23, zeolite ZSM-35, zeolite ZSM-38, zeolite ZSM-48, and the like, and mixtures thereof. Additional examples of suitable zeolites are listed in U.S. Pat. No. 4,158,621, the disclosure of which is herein incorporated by reference. It is within the scope of this invention to use zeolites from which a portion Al has been removed from the crystalline framework, and/or which have been ion-exchanged (e.g., with rare earth metal or ammonium) by any conventional ion-exchange method. Preferably, a synthetic faujasite of the Y-type (zeolite Y), more preferably a rare earth-exchange zeolite Y (REY zeolite), is employed as catalyst component (a).

The inorganic refractory matrix material in which the zeolite is embedded can be any suitable amorphous or crystalline refractory material, such as silica, alumina, silica-alumina, aluminosilicates (e.g., clays), aluminum phosphate, and the like, and mixtures thereof. Preferably, amorphous silica-alumina is used as matrix material in zeolite-containing cracking catalysts, which are generally commercially available.

The zeolite can be embedded in the inorganic refractory matrix material in any suitable manner so as to prepare cracking catalyst component (a). Preferably, a slurry of zeolite in a liquid (more preferably in water) and a slurry of the matrix material in a liquid (more preferably water) are mixed; the thus obtained dispersed zeolite/matrix mixture is separated by any suitable method (more preferably by filtration) from the liquid portion of the slurry mixture; the separated intimate zeolite/matrix mixture is at least partially dried (more preferably at about 100°-200° C.) and then calcined (more preferably by heating in air, at about 600°-900° C. for about 1-5 hours). The zeolite/matrix material can be ground and sieved during any phase of the preparation (preferably after drying) so as to obtain a material having a desired particle size range (preferably coarser than 200 mesh). The material can also be exposed to steam, e.g., at about 700°-1500° F.

Catalyst component (a) generally has a surface area, measured by nitrogen absorption in accordance with the B.E.T. method (BET/$N_2$), in the range of from about 50 to about 800 $m^2/g$, preferably from about 100 to about 400 $m^2/g$. Generally, the weight ratio of zeolite to the matrix material is in the range of from about 1:30 to about 1:1, preferably from about 1:15 to about 1:3. A non-limiting example of a suitable commercial zeolite/matrix cracking catalyst is described in Example I.

Component (b) of the cracking catalyst composition of this invention consists essentially of (i) magnesium oxide and (ii) alumina support material. The alumina support material can contain minor amounts of other ingredients (such as boria, silica, sulfates, aluminum phosphate and the like, or mixtures thereof) as long as they do not adversely affect the effectiveness of catalyst component (b). Preferably the amount of these impurities in the alumina support material does not exceed about 8 weight percent. Preferably, the alumina support material consists essentially of alumina.

The alumina support material can be made in any manner, for instance, by reacting dissolved sodium aluminate, which is basic, with dissolved aluminum sulfate, which is acidic; or by neutralizing a dissolved aluminum salt with a base such as ammonia or ammonium hydroxide; or by flame hydrolysis; or by other known methods. When alumina is made by any precipitation technique (e.g., by one of those described immediately above), the precipitated alumina hydrogel is generally washed, dried and calcined (generally at about 400°-900° C.). Generally, the alumina support material has a surface area, measured by nitrogen adsorption in accordance with the BET method, within the range of about 100 to about 500 $m^2/g$., generally about 250-400 $m^2/g$. Suitable aluminas include gamma alumina, delta alumina, chi alumina and eta alumina.

Generally, the weight ratio of magnesia to alumina in catalyst component (b) is in the range of from about 0.01:1 to about 2:1, preferably from about 0.05:1 to about 0.5:1. Component (b) can be prepared by any suitable means. Preferably, alumina is impregnated with a suitable magnesium compound dissolved in a suitable liquid (preferably water or an alcohol such a methanol), dried, and calcined at conditions substantially the same as those described for cracking catalyst component (a), so as to substantially decompose the Mg compound to MgO. Non-limiting examples of suitable Mg compounds are $Mg(NO_3)_2$, $Mg(HCO_3)_2$, $Mg(HSO_4)_2$, $MgSO_4$, Mg formate, Mg acetate, Mg oxalate and other Mg carboxylates, and mixtures of two or more Mg compounds. Preferably, Mg acetate is used for impregnating alumina The BET/$N_2$ surface area (ASTM D3037) of catalyst component (b) is generally in the range of from about 100 to about 500 $m^2/g$.

Cracking catalyst components (a) and (b) can be mixed (blended) by any suitable method, such as dry-blending (presently preferred) in a suitable mechanical mixing/blending device; or blending of a slurry (e.g., in water) of component (a) with a slurry of component (b), followed by drying and calcining. The weight ratio of catalyst component (a) to catalyst component (b) generally is in the range of from about 1:2 to about 20:1, preferably in the range of from about 2:1 to about 8:1.

It is within the scope of this invention to have from about 0.1 to about 2.0, in particular from about 0.2 to about 0.7, weight-% V (as oxide) present in the catalyst composition, in particular when said catalyst composition comprises regenerated catalyst composition (defined below) that has been used in a process for cracking vanadium-containing heavy oils. When such heavy oils are catalytically cracked, vanadium compounds from the feed are deposited on the catalyst, and these deposits are substantially converted to vanadium oxide during the oxidative regeneration of the catalyst. It is understood that the above-recited vanadium contents are average values for the entire catalyst composition, including equilibrium catalyst compositions (defined below), and it is most likely that component (b) contains a higher weight percentage of V than component (a).

Catalytic Cracking Process

The hydrocarbon containing feed stream for the catalytic cracking process of this invention can be any feedstock which contains vanadium impurities, preferably at least about 1 ppmw V (parts by weight of vanadium per million parts by weight of feed stream), more preferably about 1-200 ppmw V, most preferably about 5-50 ppmw V, and having an initial boiling point (ASTM D 1160) in excess of about 400° F., preferably boiling in the range of from about 400° to about 1300° F., more preferably boiling in the range of from about 600° to about 1200° F., all measured at atmospheric pressure conditions (about 0 psig = 1 atm). The vanadium impurities can be present in elemental or in the form of inorganic or organic compounds, more particularly as porphyrin compounds (complexes).

A particularly preferred feed stream is a heavy oil, at least about 90 volume-% of which boils above 650° F. (at atmospheric pressure). The API gravity (measured at 60° F.) of the feed generally is in the range of from about 5 to about 40, preferably from about 10 to about 30. Frequently the feedstock also contains Ramsbottom carbon residue (ASTM D 524; generally about 0.1-20 weight-%), sulfur (generally about 0.1-5 weight-%), nitrogen (generally about 0.01 weight-%), and nickel (generally about 0.1-50 ppmw).

Non-limiting examples of suitable feedstocks are topped crudes (residua), distillation bottom fractions, heavy gas oils, heavy cycle oils, slurry oils (decant oils), hydrotreated residua (i.e., having been hydrotreated in the presence of a promoted hydrotreating catalyst, preferably a Ni, Co, Mo-promoted alumina catalyst), heavy liquid coal pyrolyzates, heavy liquid products from extraction of coal, heavy liquid products from liquefaction of coal, heavy liquid products from tar sand, shale oils, heavy fractions of shale oils, and the like. Presently most preferred feedstocks are hydrotreated residua.

Any suitable reactor can be used for the catalyst cracking process of this invention. Generally a fluidized-bed catalytic cracking (FCC) reactor (preferably containing one or two or more risers) or a moving bed catalytic cracking reactor (e.g., a Thermofor catalytic cracker) is employed. Presently preferred is a FCC riser cracking unit. Examples of such FCC cracking units are described in U.S. Pat. Nos. 4,377,470 and 4,424,116, the disclosures of which are herein incorporated by reference.

The cracking catalyst composition which has been used in a catalytic cracking process (commonly called "spent catalyst") contains deposits of coke and metals or compounds of metals (in particular nickel and vanadium compounds). The spent catalyst is generally removed from the cracking zone and then separated from formed gases and liquid products by any conventional separation means (e.g., in a cyclone), as is described in the above-cited patents and also in "Petroleum Refining" by James H. Gary and Glenn E. Handwerk, Marcel Dekker, Inc., 1975, the disclosure of which is herein incorporated by reference.

Adhered liquid oil is generally stripped from the spent catalyst by flowing steam (preferably having a temperature of about 700°-1,500° F.). The steam-stripped catalyst is generally heated in a free oxygen-containing gas stream in the regeneration unit of the cracking reactor, as is shown in the above-cited references, so as to produce a regenerated catalyst. Generally, air is used as the free oxygen containing gas; and the temperature of the catalyst during regeneration with air preferably is about 1100°-1400° F. (i.e., about 590°-760° C.). Substantially all coke deposits are burned off, and metal deposits (in particular vanadium compounds) are at least partially (preferably substantially) converted to metal oxides during regeneration. Enough fresh, unused cracking catalyst is generally added to the regenerated cracking catalyst, so as to provide a so-called equilibrium catalyst of desirably high cracking activity. At least a portion of the regenerated catalyst, preferably the equilibrium catalyst, is generally recycled to the cracking reactor. Generally the recycled regenerated catalyst, preferably the recycled equilibrium catalyst, is transported by means of a suitable lift gas stream (e.g., steam and/or hydrogen and/or gaseous hydrocarbons) to the cracking reactor and introduced into the cracking zone (with or without the lift gas).

Specific operating conditions of the cracking operation will depend on the type of feed, the type and dimensions of the cracking reactor and the oil feed rate, and can easily be determined by those having ordinary skill in the art. Examples of operating conditions are described in the above-cited references and in many other publications. In an FCC operation, generally the weight ratio of catalyst composition to oil feed (i.e., hydrocarbon-containing feed) ranges from about 2:1 to about 10:1, the time of contact between oil feed and catalyst is in the range of about 0.2 to about 3 seconds, and the cracking temperature is in the range of from about 800° to about 1200° F. Generally steam is added with the oil feed to the FCC reactor so as to aid in the dispersion of the oil feed as droplets. Generally the weight ratio of steam to oil feed is in the range of from bout 0.01:1 to about 0.5:1. Hydrogen gas can also be added to the cracking reactor; but presently $H_2$ addition is not a preferred feature of this invention. Thus, added hydrogen gas should preferably be substantially absent from the cracking zone.

The separation of liquid products into various gaseous and liquid product fractions can be carried out by any conventional separation means, generally by fractional distillation. The most desirable product fraction is gasoline (ASTM boiling range: about 180°-400° F.). Non-limiting examples of such separation schemes are shown in "Petroleum Refining" by James H. Gary and Glenn E. Handwerk, cited above.

The following examples are presented to further illustrate the invention and are not to be considered unduly limiting the scope of this invention.

EXAMPLE I

This example illustrates the preparation of several cracking catalyst compositions, their impregnation with vanadium, and the performance of these V-impregnated catalyst compositions in cracking tests (so as to simulate cracking performance of V-contaminated equilibrium cracking catalysts).

A sample of 10 grams of Ketjen-L alumina (surface area: 380 $m^2/g$; pore volume: 2.0 g/cc; average particle size: 95 microns; $SiO_2$ content: 5.0 weight-%; $SO_4$ content: 2.0 weight-%; $Na_2O$ content: 0.15 weight-%; provided by the Ketjen Catalysts Division of Akzo America; Pasadena, TX) was mixed with a solution of 1.38 grams of magnesium acetate in 50 cc methanol. The mixture was thoroughly stirred and then dried at an elevated temperature.

Thereafter, the dried material was mixed with a solution of 1.7 grams of vanadyl naphthenate in hot toluene. The mixture obtained was dried, then gradually heated in a nitrogen atmosphere to 1200° F., and finally heated in air at that temperature for 1.5 hours. This material, alumina-supported MgO/V oxide (containing 1.5 weight-% Mg, i.e., 2.5 weight-% MgO and 0.5 weight-% vanadium), is labeled Catalyst Material A.

Another 10 g sample of Ketjen-L alumina was impregnated with vanadyl acetate, dried and calcined as described immediately above. This material (V oxide on alumina, containing 0.5 weight-% V; no MgO) is labeled Catalyst Material B.

A sample of 150 grams of a commercial zeolite-containing cracking catalyst composition, GXO-40 (provided by Davison Division of W. R. Grace and Company), was impregnated with 25 grams of vanadyl acetate, as described above, dried and calcined in air at about 1200° F. for 3 hours. This material (containing 0.5 weight-% V on GXO-40), is labeled Catalyst Material C.

Control Catalyst Material D was obtained by steam-treating Catalyst Material C at 1350° F. for 5 hours, and simulates an ordinary steamed, regenerated vanadium-contaminated cracking catalyst composition.

Control Catalyst Material E was prepared by dry-blending 8 parts by weight of Catalyst Material C with 2 parts by weight of Catalyst Material B, and then exposing the physical mixture to steam at 1350° F. for 5 hours. Material E thus contained 80 weight-% of GXO-40 (with 0.5 weight-% V) and 20 weight-% of alumina (with 0.5 weight-% V).

Invention Catalyst Material F was prepared by dry-blending 8 parts by weight of Catalyst Material C with 2 parts by weight of Catalyst Material A, and then exposing the physical mixture to steam at 1350° F. for 5 hours. Material F thus contained 80 weight-% of GXO-40 (with 0.5 weight-% V) and 20 weight-% of MgO/alumina (with 0.5 weight-% V).

EXAMPLE II

Steam-treated Catalyst Materials D, E and F (see Example I) were evaluated in microactivity cracking tests (MAT), substantially in accordance with ASTM D 3907-80, employing a hydrotreated heavy petroleum fraction (boiling above 650° F. at atmospheric conditions) as feed. Cracking conditions were: cracking temperature of 950° F.; catalyst:oil weight ratio of 3:1; 5.0 g catalyst composition employed; 1.25 minute feed injection, followed by a 10 minute nitrogen purge; weight hourly space velocity of feed oil: 16 g/g catalyst-hour. Test results are summarized in Table I.

TABLE I

| Catalyst Material | D (Control) | E (Control) | F (Invention) |
|---|---|---|---|
| Wt % of Zeolite Catalyst | 100 | 80 | 80 |
| Wt % of Alumina Diluent | 0 | 20 | 20 |
| Wt % MgO in Alumina Diluent | — | 0 | 2.5 |
| Wt % V in Catalyst Material | 0.5 | 0.5 | 0.5 |
| Conversion (Wt %) | 67.6 | 70.7 | 79.2 |
| Gasoline Yield (Wt %) | 44.9 | 44.2 | 50.1 |
| Light Cycle Oil Yield (Wt %) | 16.1 | 17.6 | 14.4 |
| Heavy Cycle Oil Yield (Wt %) | 16.4 | 11.7 | 6.5 |
| Hydrocarbon Gas Yield (Wt %) | 11.0 | 10.5 | 12.3 |

TABLE I-continued

| Catalyst Material | D (Control) | E (Control) | F (Invention) |
|---|---|---|---|
| Coke Yield (Wt %) | 11.6 | 16.0 | 16.8 |
| Hydrogen Yield (SCF/BBL*) | 295 | 471 | 410 |

*Standard cubic feet of $H_2$ per barrel of feed.

Test data in Table I clearly show that the presence of a alumina diluent containing 2.5 weight-% MgO resulted in a significant increase in feed conversion and gasoline yield.

EXAMPLE III

In this example the cracking performance of physical blends of V-impregnated zeolite-containing cracking catalyst and either V-impregnated MgO/alumina (this invention) or V-impregnated MgO/silica (U.S. Pat. No. 4,781,816).

Control Catalyst Material G was prepared by dry-blending 80 weight-% of GXO-40 (with 0.5 weight-% V) and 20 weight-% of MgO/silica (with 2.5 weight-% MgO and 0.5 weight-% V) having been prepared substantially in accordance with the procedure for Composition A in Example I of U.S. Pat. No. 4,781,816, the entire disclosure of which is incorporated herein by reference.

MAT cracking tests were carried out in accordance with the procedure of Example II of this application. Test Results are summarized in Table II.

TABLE II

| Catalyst Material | F (Invention) | G (Control) |
|---|---|---|
| Wt % of Zeolite Catalyst | 80 | 80 |
| Diluent | $MgO/Al_2O_3$ | $MgO/SiO_2$ |
| Wt % MgO in Diluent | 2.5 | 2.5 |
| Wt % V in Catalyst Material | 0.5 | 0.5 |
| Conversion (Wt %) | 79.2 | 62.2 |
| Gasoline Yield (Wt %) | 50.1 | 39.5 |
| Light Cycle Oil Yield (Wt %) | 14.4 | 15.4 |
| Heavy Cycle Oil Yield (Wt %) | 6.5 | 22.4 |
| Hydrocarbon Gas Yield (Wt %) | 12.3 | 10.3 |
| Coke Yield (Wt %) | 16.8 | 12.4 |
| Hydrogen Yield (SCF/BBL) | 410 | 275 |

Test results in Table II clearly show the advantage, in terms of conversion and gasoline yield, of the cracking catalyst composition of this invention (Catalyst Material F with MgO/Alumina as diluent) over that of U.S. Pat. No. 4,781,816 (Catalyst Material G with MgO/-silica as diluent).

Reasonable variations, modifications and adaptations for various usages and conditions can be made within the scope of the disclosure and the appended claims, without departing from the scope of this invention.

That which is claimed is:

1. A catalytic cracking process comprising the step of contacting in a cracking zone a hydrocarbon containing feed stream having an initial boiling point of at least about 400° F., measured at about 0 psig, and containing vanadium impurities with a catalyst composition comprising a physical mixture of (a) zeolite embedded in an inorganic refractory matrix material, and (b) magnesium oxide on alumina support material, under such cracking conditions as to obtain at least one liquid hydrocarbon containing product stream having a lower initial boiling point and a higher API gravity than said feed stream.

2. A process in accordance with claim 1 wherein said alumina support material consists essentially of alumina.

3. A process in accordance with claim 1 wherein said zeolite is selected from the group consisting of faujasite, chabazite, mordenite, offretite, erionite, Zeolon, zeolite X, zeolite Y, zeolite L, zeolite ZSM-4, zeolite ZSM-5, zeolite ZSM-11, zeolite ZSM-12, zeolite ZSM-23, zeolite ZSM-35, zeolite ZSM-38, zeolite ZSM-48 and mixtures thereof; and said inorganic refractory matrix material is selected from the group consisting of silica, alumina, silica-alumina, aluminosilicates, aluminum phosphate and mixtures thereof.

4. A process in accordance with claim 1 wherein the weight ratio of said zeolite to said inorganic refractory matrix material is in the range of from about 1:30 to about 1:1, and the $BET/N_2$ surface area of component (a) of said catalyst composition is in the range of from about 50 to about 800 $m^2/g$.

5. A process in accordance with claim 1 wherein in component (b) of said catalyst composition the weight ratio of magnesia to alumina is in the range of from about 0.01:1 to about 2:1.

6. A process in accordance with claim 1 wherein the surface area of said component (b) of said catalyst composition has a surface area in the range of from about 100 to about 500 $m^2/g$, and the weight ratio of magnesia to alumina is in the range of from about 0.05:1 to about 0.5:1.

7. A process in accordance with claim 1 wherein said component (b) of said catalyst composition has been prepared by a process comprising the steps of impregnating alumina with a suitable magnesium compound dissolved in a suitable liquid, drying the thus impregnated alumina, and calcining the dried, impregnated alumina under such conditions as to substantially convert said magnesium compound to MgO.

8. A process in accordance with claim 1 wherein in said catalyst composition the weight ratio of component (a) to component (b) is in the range of from about 1:2 to about 20:1.

9. A process in accordance with claim 1 wherein said weight ratio of component (a) to component (b) is in the range of from about 2:1 to about 8:1.

10. A process in accordance with claim 1 wherein said cracking catalyst composition additionally comprises about 0.1 to about 2.0 weight-% V as vanadium oxide.

11. A process in accordance with claim 1 wherein said feed stream contains about 1–200 ppmw V.

12. A process in accordance with claim 1 wherein said feed stream contains about 5–50 ppmw V and has a boiling range of from about 400° to about 1300° F., measured about 0 psig.

13. A process in accordance with claim 12, wherein said feed stream has an API gravity in the range of from about 5 to about 40, and contains about 0.1–20 weight-% Ramsbottom carbon residue and about 0.1–5 weight-% sulfur.

14. A process in accordance with claim 1 wherein said contacting is carried out in a fluidized-bed catalytic cracking reactor.

15. A process in accordance with claim 1 wherein said cracking conditions comprises a weight ratio of said catalyst composition to said hydrocarbon containing feed stream in the range of from about 2:1 to about 10:1, and a cracking temperature in the range of from about 800° to about 1200° F.

16. A process in accordance with claim 1 wherein steam is present during said contacting under cracking conditions and the weight ratio of steam to said hydrocarbon containing feed stream is in the range of from about 0.01:1 to about 0.5:1.

17. A process in accordance with claim 1 comprising the additional steps of removing said cracking catalyst composition from said cracking zone after it has been used in said cracking zone;

separating the thus removed cracking catalyst composition from gases and said at least one liquid product stream, exposing at least a portion of the thus separated cracking catalyst composition to flowing steam so as to strip adhered liquids from said cracking catalyst composition, and heating the thus steam-stripped cracking catalyst composition with a free oxygen containing gas so as to substantially remove coke deposits from said steam-stripped cracking catalyst composition, substantially convert vanadium compounds deposited thereon to vanadium oxide, and thus obtain a regenerated cracking catalyst composition.

18. A process in accordance with claim 17 further comprising the additional step of recycling at least a portion of said regenerated cracking catalyst composition to said cracking zone.

19. A process in accordance with claim 18, wherein fresh, unused cracking catalyst composition has been added to said regenerated catalyst composition before said recycling.

* * * * *